US006263805B1

(12) United States Patent
Taguchi et al.

(10) Patent No.: US 6,263,805 B1
(45) Date of Patent: Jul. 24, 2001

(54) BOX TYPE STRUCTURAL BODY AND VEHICLE END SILL

(75) Inventors: Makoto Taguchi; Toshinori Marunaka, both of Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 09/452,868

(22) Filed: Dec. 2, 1999

(30) Foreign Application Priority Data

Dec. 4, 1998 (JP) ..... 10-345005

(51) Int. Cl.[7] ..... B61D 17/00

(52) U.S. Cl. ..... 105/421; 105/396; 105/402; 105/410; 105/422; 105/413

(58) Field of Search ..... 105/396, 397, 105/400, 401, 402, 404, 409, 410, 411, 413, 414, 421, 422; 296/187, 188, 189, 191, 193, 194, 203.01, 204, 203.02, 203.04

(56) References Cited

U.S. PATENT DOCUMENTS

| | | | | |
|---|---|---|---|---|
| D. 32,543 | * | 4/1900 | Hansen | 105/421 |
| 825,019 | * | 7/1906 | Dodds | 105/410 |
| 1,053,201 | * | 2/1913 | Moore | 105/421 |
| 4,235,170 | * | 11/1980 | Bauer | 105/402 |
| 4,917,019 | * | 4/1990 | Hesch et al. | 105/421 |
| 6,196,135 | * | 3/2001 | Kashima et al. | 105/396 |

FOREIGN PATENT DOCUMENTS

| | | |
|---|---|---|
| 0 612 647 A1 | 8/1994 | (EP) . |
| 2 140 937 | 1/1973 | (FR) . |
| 45-30172 | 11/1970 | (JP) . |
| 53-30119 | 8/1978 | (JP) . |
| 4-292258 | 10/1992 | (JP) . |

* cited by examiner

*Primary Examiner*—Mark T. Le
(74) *Attorney, Agent, or Firm*—Oliff & Berridge, PLC

(57) ABSTRACT

There is provided a vehicle end sill or the like, in which lap joints formed by one side lap welding are not simply deformed or broken off. An end sill 1 is formed as a box type structural body which includes lap joints W1 which are formed by one side lap welding conducted only from the outer side. Edge portions 12*a* and 13*a* of face plates 12, 13 to be superposed on the surfaces 11*a* and 11*b* of the end member (intermediate member) 11 are formed as a zigzag shape. The end member has the longitudinal axis substantially perpendicular to the direction along which the load is adapted to be applied to the end sill 1. Lap welding (one side welding conducted only from the outer side) is conducted along the edge portion 12*a* and 13*a* of the zigzag shape.

14 Claims, 5 Drawing Sheets

BOX TYPE STRUCTURAL BODY AND VEHICLE END SILL

BACKGROUND OF THE INVENTION

1. Field of the Invention

The present invention relates to a box type structural body containing a lap joint to which welding can not be applied from the inner side of the body, and a vehicle end sill which corresponds to such box type structural body.

2. Description of the Related Art

A structural body for a head portion of a (commuter) railway vehicle (rolling stock) is shown in FIG. 4. In an example in FIG. 4, a bone member, which is located at a front end (or rear end) of a vehicle A and is extending along the vehicle width direction, is called an "end sill". An end sill 1 is provided to bear the load applied when the vehicle A collides with the other vehicle or the object. The end sill 1 is a box type structural body which has, for example, a longitudinal sectional shape as shown in FIG. 5A.

The end sill 1' shown in FIG. 5A is formed as a box shape by extending a beam-like end member 11 such as channel member at a front end portion of the vehicle A along the width direction. Upper and lower face plates 12, 13 are welded to upper and lower surfaces of the end member 11. The box type structure is a closed (or almost closed) structure and has no inner space into which an operator or a welding machine can enter. Therefore, lap joints W' between the end member 11 and the upper and lower face plates 12, 13 are welded merely from the outer side of the box type structure and are not welded from the inner side of the box type structure. A weld seam W' of the joint W' extends linearly, as shown in FIG. 5B. The weld seam Wa' of the joint W' is positioned perpendicularly to the direction of the load applied from the left side in FIG. 5B, which is caused by a collision of the vehicle A with the other object (such as the other vehicle).

The face plates 12, 13 at the end sill 1' shown in FIGS. 5A to 5C can be deformed in the form of an out-of-plane deformation by low load, and in some cases they are broken off since the bending moment is applied to the joint W' correspondingly. When the load caused by the collision is applied from the left side of FIG. 5A with the result of an application of the bending moment onto the joints W' (see an arrow shown in FIG. 5D), such bending moment is received only by a throat thickness of a weld bead of the weld seam Wa' since the weld seam Wa' of the joint W' is formed as a straight line. For this reason, the joint W' tends to deform as shown in FIG. 5D and also tends to break of f as shown in FIG. 5E. In this manner, if the joint W' is easily deformed and broken off, a collision energy cannot be sufficiently absorbed by the end sill 1' which includes the face plates 12, 13, etc.

As for the joint W' in the end sill 1' as shown in FIGS. 5A to 5E in the related art, FIG. 5F is a graph showing a typical relation between an amount of deformation $\delta$ and an reaction P of the joint W' when the joint W' is deformed. Since the joint W' is broken off as shown in FIG. 5E at a point x of time when the reaction P is increased, the succeeding reaction P is reduced abruptly. An amount of collision energy which can be absorbed by the joint W' can be expressed by a shaded area (i.e., $\int P d\delta$) in FIG. 5F. As shown in FIG. 5F, the amount of absorbed collision energy is not sufficiently large. If the absorption energy of the joint W' is small, the energy which can be absorbed by the end sill 1' is also small. Therefore, remaining collision energy, which can not be absorbed by the end sill 1', acts onto other portions of the vehicle A and thus the considerable damage of the vehicle A is caused.

Although above-mentioned explanation has been made by taking the vehicle end sill into consideration as an example, the similar problem also occurs in other box type structural bodies. In other words, if the box type structural body includes the lap joints which are linearly welded only from the outer side (one side welding) for the structural reason and the direction of the weld seams of the lap joints is set perpendicular (or closely perpendicular) to the direction of the load, the lap joints can be broken off easily when they receive the load. In addition, in the end sill 1' in FIG. 5A and the box type structural body in the related art, another fracture mode may be considered. That is a shear fracture of the weld bead in the form that the end member 11 and the face plates 12, 13 are shifted in parallel with their lapped faces without the deformation shown in FIGS. 5D and 5E.

SUMMARY OF THE INVENTION

An object of the present invention is to provide a box type structural body and a vehicle end sill, of which the above-mentioned lap joint welded by one side lap welding cannot be broken off easily.

According to a first aspect of the present invention, a box type structural body comprises: a pair of plate members each having an edge which is formed in a zigzag shape; the plate members facing each other with a clearance therebetween; an intermediate member disposed between the plate members, the intermediate member having a pair of surfaces to which the zigzag edges of the plate members are superposed and attached respectively by lap weldings along the zigzag edges, the lap weldings being conducted outside the structural body, the intermediate member having a longitudinal axis which is substantially perpendicular to a direction along which a load is adapted to be applied to the structural body.

According to such box type structural body, if it receives the load in the direction substantially perpendicular to the direction of the longitudinal axis of the intermediate member, the joint made by the lap welding is never simply broken off unlike the related art shown in FIG. 5. This is because the weld seam (only one side) of the lap joint is formed as the zigzag shape with the result that not only the throat of the weld bead but also the zigzag weld seam can stand the bending moment unlike related art shown in FIG. 5, when the structural body receives the load along the above-mentioned direction. In other words, in the box type structural body, the weld bead can stand the larger shearing load since the sectional area is increased with the increase of the total length and a part of the total length is provided along the depth direction of the zigzag shape. Therefore, when the bending moment is caused like that in FIG. 5D, he weld bead can bear the bending moment by the small stress. Since the joint is not easily deformed or ruptured, the energy which can be absorbed by the box type structural body can be considerably increased.

In the box type structural body, a depth and a pitch of the zigzag edge may be set such that a stress caused by the load at a weld bead of the lap welding does not come up to its yield point even if a full plastic bending moment of the plate member is caused in a plane substantially perpendicular to the longitudinal axis of the intermediate member.

The dimensions of the zigzag shape are decided as above, the weld bead of the joint never generates its plastic deformation until the plate member is brought into its full plastic deformation state even if the above-mentioned bending moment is caused by the load. In other words, since the joint can stand such large bending moment, the energy absorbed by the box type structural body can be increased as far as material of respective members are selected appropriately.

In the box type structural body, the zigzag shape may include a rectangular sawtooth shape.

In the box type structural body, the zigzag shape may include a triangular sawtooth shape.

In the box type structural body, the zigzag shape may include a trapezoidal sawtooth shape.

In the box type structural body, the zigzag shape may include a circular-arc sawtooth shape.

According to a second aspect of the present invention, a vehicle end sill comprises: a pair of plate members each having an edge which is formed in a zigzag shape; the plate members facing each other with a clearance therebetween; an intermediate member extending in a width direction of an end portion of a vehicle, the intermediate member being disposed between the plate members, the intermediate member having a pair of surfaces to which the zigzag edges of the plate members are superposed and attached respectively by lap weldings along the zigzag edges, the lap weldings being conducted outside the vehicle end sill, the intermediate member having a longitudinal axis which is substantially perpendicular to a direction along which a load is adapted to be applied to the vehicle end sill.

Such end sill receives the impact load from the front side (or rear side) along the direction substantially perpendicular to the longitudinal axis of the intermediate member (i.e., longitudinal direction of the vehicle) when the collision of the vehicle is caused. Then, when the intermediate member (end member) is deformed by such load, the end sill is not simply ruptured because the joint is welded along the edge portion of the zigzag shape and then transfers the deformation to the plates members, etc. Accordingly, the absorption energy of the end sill can be increased as a whole during the collision of the vehicle. The energy transferred to portions other than the end sill can be reduced. As a result, the damage range of the vehicle can be reduced.

In the vehicle end sill, a depth and a pitch of the zigzag edge may be set such that a stress caused by the load at a weld bead of the lap welding does not come up to its yield point even if a full plastic bending moment of the plate member is caused in a plane substantially perpendicular to the longitudinal axis of the intermediate member.

In the vehicle end sill, the intermediate member may be formed as a convex shape which protrudes against the direction of the load.

According to such end sill, the absorption energy can be increased as mentioned above and in addition the impact at the time of collision can be made as gentle. This is because the center portion of the intermediate member (end member) is protruded forward in the vehicle. At the beginning of the collision, only the center portion abuts to the opposite object, and then the contact portion (portion which comes into contact with the opposite object) gradually spreads in the width direction of the intermediate member.

The vehicle end sill may further comprise two or more pieces projecting from a front surface of the intermediate member in a substantially horizontal direction and disposed at a predetermined height on the vehicle.

If the end sill is located at a predetermined height and has such projecting pieces on the front surface of the intermediate member (end member), both vehicles collide only by the intermediate members when both vehicles collide with each other. Therefore, it can be prevented that the end sill of one vehicle runs on to portions other than the end sill of the opposite vehicle. This is because, when the vehicles having similar end sills collide with each other, at least on the horizontal projecting pieces provided to (the end sill of) one vehicle enters between two or more horizontal projecting pieces provided to (the end sill of) the opposite vehicle to restrict the vertical displacement, so that the contact between the end sills is not disengaged vertically with each other. If the end sills of one vehicle collide with the end sill of the opposite vehicle and is not disengaged mutually, the end sill in no way runs on to the floor, etc. of the opposite vehicle. As a result, the end sills of both vehicles can suppress the damage of other portions of the opposite vehicle to the lowest minimum while absorbing the collision energy appropriately.

In the vehicle end sill, the zigzag shape may include a rectangular sawtooth shape.

In the vehicle end sill, the zigzag shape may include a triangular sawtooth shape.

In the vehicle end sill, the zigzag shape may include a trapezoidal sawtooth shape.

In the vehicle end sill, the zigzag shape may include a circular-arc sawtooth shape.

DESCRIPTION OF THE PREFERRED EMBODIMENTS

Figure 1A:
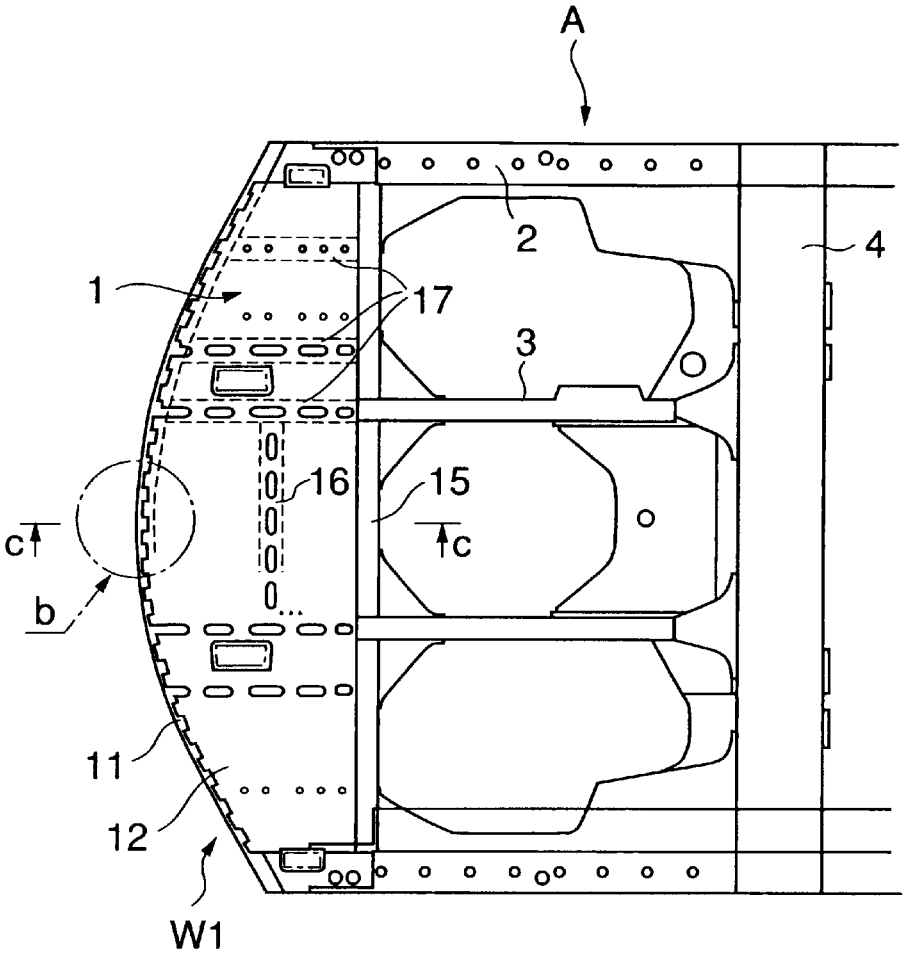
FIG. 1A is a plan view showing mainly an end sill 1 provided to a vehicle A shown in FIG. 4, according to an embodiment of the present invention.
Figure 1B:
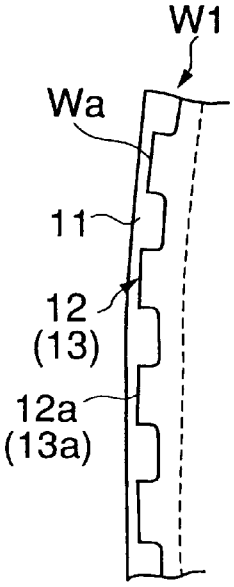
FIG. 1B is a fragmental plan view showing details of a part b in FIG. 1A.
Figure 1C:
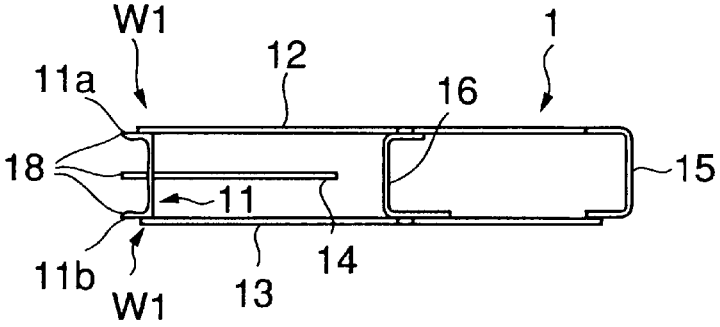
FIG. 1C is a sectional view showing a sectional shape, taken along a line c—c in FIG. 1A.
Figure 2A:
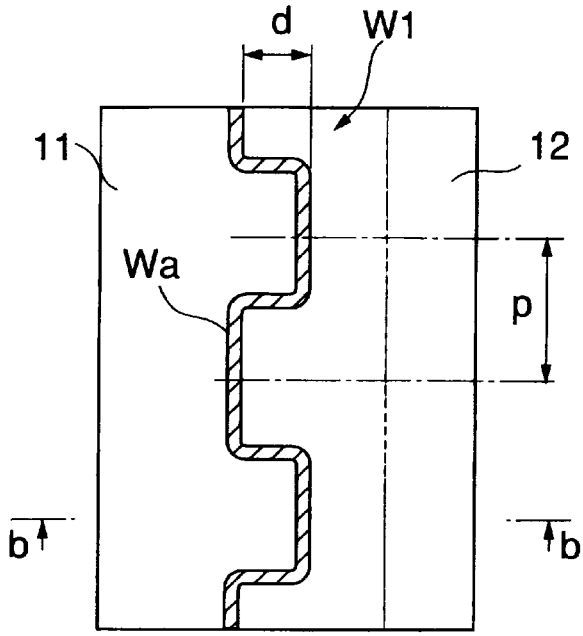
FIG. 2A is a plan view showing details of a joint W1 in the end sill 1 in FIG. 1A.
Figure 2B:
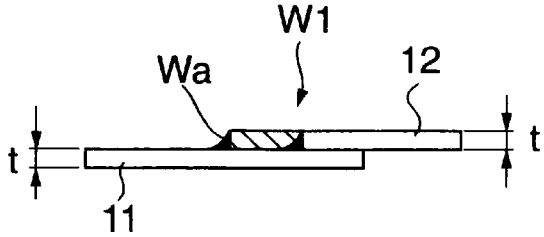
FIG. 2B is a sectional view showing a sectional shape, taken along a line b—b in FIG. 2A.
Figure 2C:
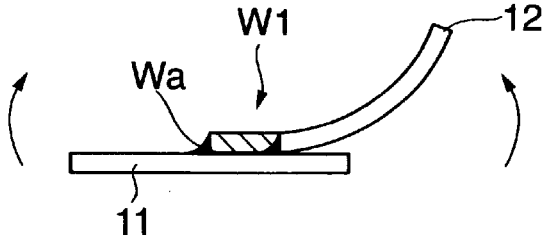
FIG. 2C is a sectional view showing a deformed state of the joint W1 when a bending moment is applied to joint W1.
Figure 2D:
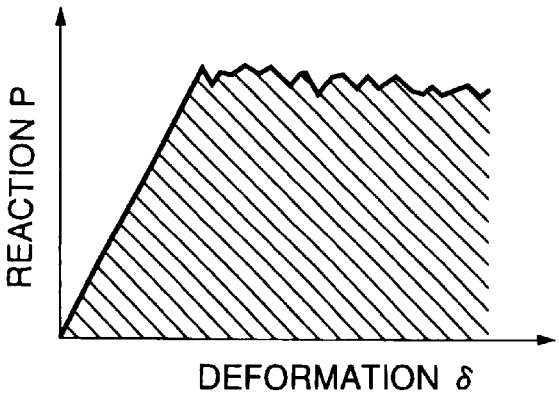
FIG. 2D is a graph showing a relation between a reaction P of the joint W1 and an amount of deformation δ of the joint W1 when the joint W1 is deformed.
Figure 4:
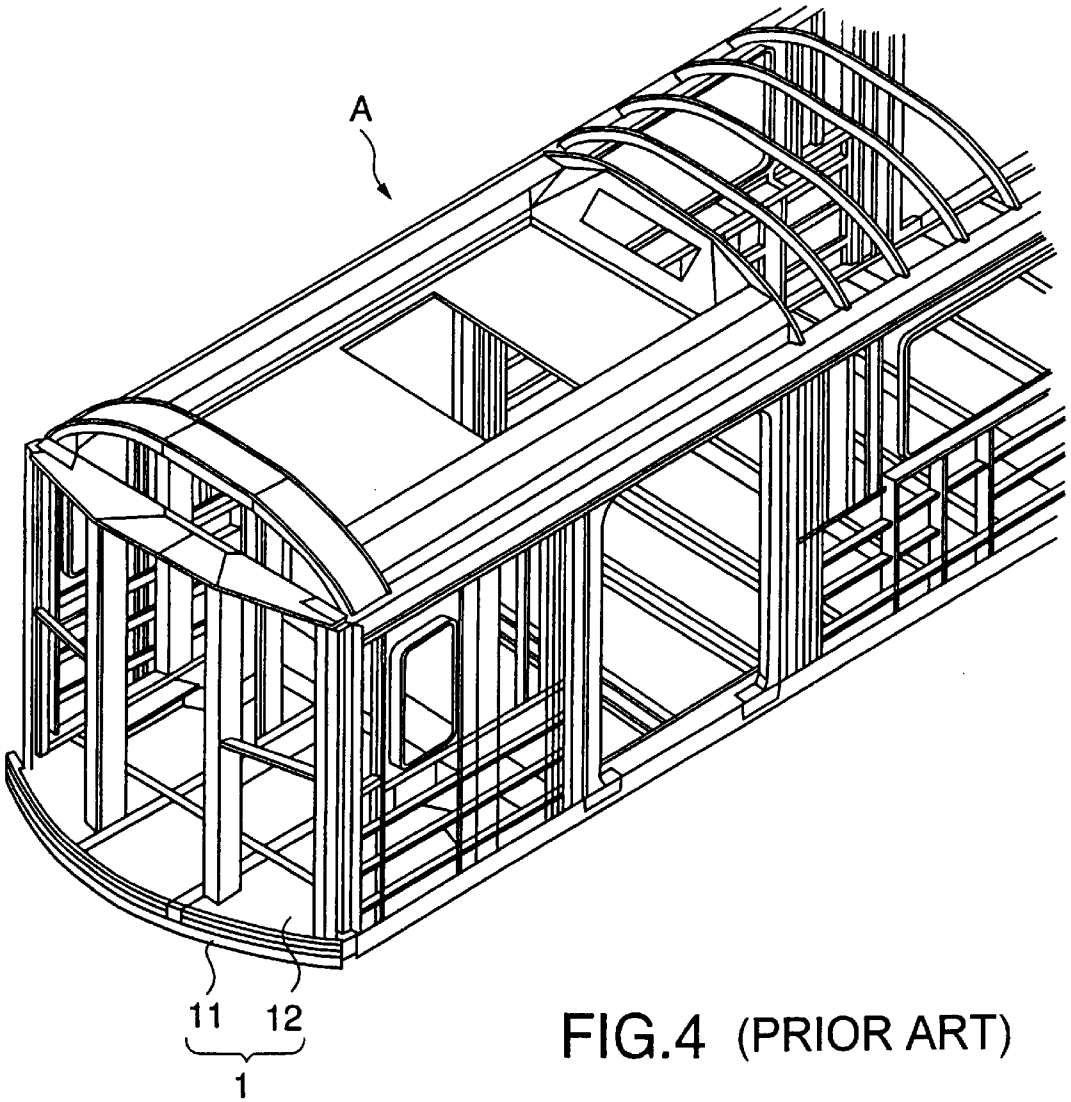
FIG.4 (PRIOR ART)
FIG. 4 is a perspective view showing a head portion of a railway vehicles.

FIGS. 1A to 2D show an embodiment of the present invention. FIG. 1A is a plan view showing mainly an end sill 1 provided to a vehicle A shown in FIG. 4, according to the embodiment of the present invention. FIG. 1B is a fragmental plan view showing details of a part b in FIG. 1A. FIG. 1C is a sectional view showing a sectional shape, taken along a line c—c in FIG. 1A. FIG. 2A is a plan view showing details of a joint W1 in the end sill 1 in FIG. 1A. FIG. 2B is a sectional view showing a sectional shape, taken along a line b—b in FIG. 2A. FIG. 2C is a sectional view showing a deformed state of the joint W1 when a bending moment is applied to the joint W1 along the direction indicated by an arrow in FIG. 2C. FIG. 2D is a graph showing a relation between an amount of deformation δ of the joint W1 (abscissa) and a reaction P of the joint W1 (ordinate) when the joint W1 is deformed.

As explained above with reference to FIG. 4, the end sill 1 is provided to a front end (or a rear end) of the commuter railway vehicle A. Although a structure at the front end of the vehicle will be explained hereinafter, such explanation is true of the rear end sill.

The end sill 1 protrudes forwardly at a height of the floor of the vehicle A, comparing to the other portions of the vehicle A. As shown in FIG. 1C, the end sill 1 is formed as a box shape. A beam-like end member (intermediate member) 11 of shape steel extends at a front portion of the vehicle A along the vehicle width direction. Upper and lower horizontal face plates (steel plates) 12, 13 are welded to upper and lower surfaces 11*a*, 11*b* of the end member 11 respectively. The face plates 12, 13 are connected to a frame 15 at their rear portions. As shown in FIG. 1A, frames 16, 17 are arranged in the middle portion of the end sill 1 so as to extend along the longitudinal and lateral directions respectively. A rear portion of the end sill 1 is connected to a body bolster 4 via a side sill 2 and a center sill 3, and then the body bolster 4 is connected to the backward structure.

The end member 11 and the upper face plate 12 are jointed by the lap joint W1 which is formed by the one side lap welding conducted only from the outer side of the end sill 1. The end member 11 and the lower face plate 13 are also jointed by the lap joint W1 which is formed by the one side lap welding conducted only from the outer side of the end sill 1. The reason why the lap welding is conducted only from the outer side of the end sill 1 is that the end sill 1 is formed as the closed box shape as described above. Another reason is that a reinforcing plate 14 attached to a back surface (rear surface between the face plates 12, 13) of the end member 11 makes it difficult to conduct the welding operation from the inner side of the face plates 12, 13, even before the end member 11 is assembled into the box shape.

As described above, the end sill 1 is provided for the purpose of absorbing an energy (collision energy) generated when the vehicle A (FIG. 4) collides with the other vehicle, etc. The more energy is absorbed by the end sill 1, the less energy is transferred to portions other than the end sill 1 with the result of reducing the damage of the vehicle A. Therefore, following structures to increase the absorption energy are adopted in the end sill 1 of this embodiment.

Figure 5A:
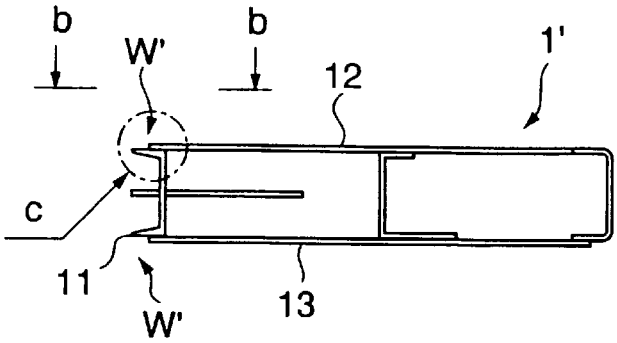
FIG.5A (PRIOR ART)
FIG. 5A is a vertical sectional view showing an end sill 1' and a join W' in a related art.
Figure 5B:
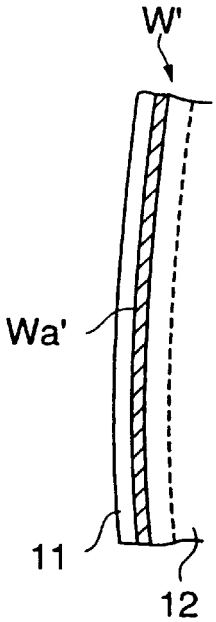
FIG.5B (PRIOR ART)
FIG. 5B is a fragmental plan view showing a weld seam Wa' of the joint W', taken along a line b—b in FIG. 5A.
Figure 5C:
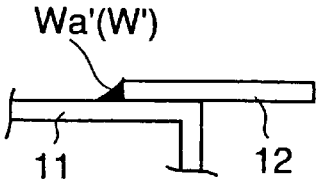
FIG.5C (PRIOR ART)
FIG. 5C is a view showing details of a part c in FIG. 5A.
Figure 5D:
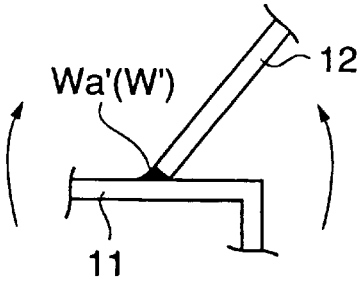
FIG.5D (PRIOR ART)
FIG. 5D is a sectional view showing a deformed state of the joint W' when such joint W' receives the bending moment.
Figure 5E:
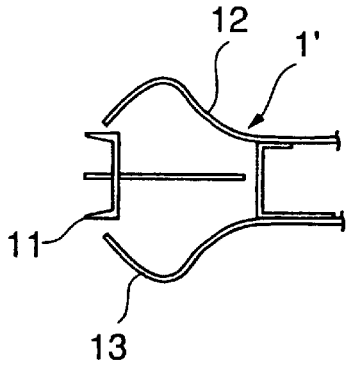
FIG.5E (PRIOR ART)
FIG. 5E is a sectional view showing the end sill 1' when the joints W' are broken off.
Figure 5F:
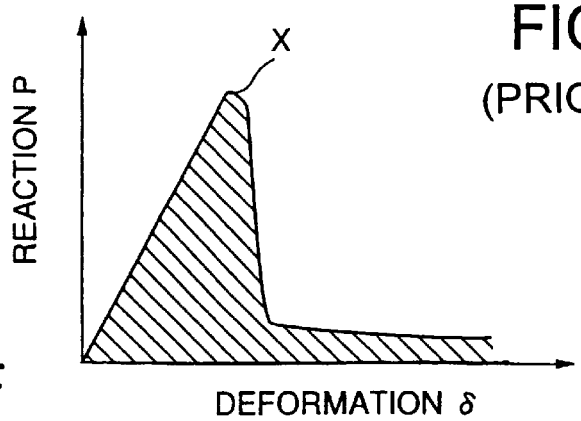
FIG.5F (PRIOR ART)
FIG. 5F is a graph showing a relation between an reaction P and an amount of deformation δ of the joint W'.

A) Edge portions 12*a* and 13*a* of the face plates 12 and 13, which are jointed onto the upper and lower surfaces 11*a* and 11*b* of the end member 11 as the lap joints W1, are formed as the zigzag or comb-teeth shape as shown in FIG. 1B. The fillet welding or groove fillet welding, whose weld seam Wa extends like a rectangular sawtooth as shown in FIG. 2A, is applied along the edge portion 12*a* (13*a*) of the zigzag shape from the outer side of the end sill 1. Several merits can be gained from the zigzag type joint W1. First, since a total length and a sectional area of the weld seam can be increased comparing to the straight lap joint W' shown in FIG. 5B, the fracture due to the shear is hard to occur at the zigzag joint W1. Then, even if the bending moment (which is caused in the plane perpendicular to the longitudinal axis of the end member 11) is caused as shown in FIG. 2C when the end member 11 is displaced toward the right side in FIG. 1C by the deformation at the time of collision, the weld seam is hard to break off because a part of the total length of the weld seam which corresponds to the depth of the zigzag shape (comb teeth) can stand the bending moment. If the weld bead of the joint W1 is difficult to break off in this manner, such a situation is seldom brought about that connections between the end member 11 and the face plates 12, 13 are ruptured. Accordingly, the end sill 1 can absorb the considerable collision energy by the out-of-plane deformation of the face plates 12, 13, etc. FIG. 2D is a graph showing a relation between an amount of deformation δ and a reaction P of the joint W1 when the joint W1 receives the load. The joint W1 can continue to generate the large reaction P because the weld seam is hard to break off, with the result that the collision energy absorbed by the lap joint W1 (an area of the hatched portion in FIG. 2D which corresponds to $\int P d\delta$) can be extremely increased.

B) A dimension of the zigzag lap joint W1 is decided based on strength design such that, even if the above-mentioned bending moment is caused, the plastic deformation of the weld bead of the joint W1 is not caused until the face plates 12, 13, which is easily deformed comparing to the end member 11, are brought into their full plastic deformation state. More particularly, a depth d and a pitch p of the zigzag shape shown in FIG. 2A are decided to satisfy following conditions. That is, assume that the strength of the width per pitch of the zigzag shape in the joint W1 is examined and then a thickness of the face plates 12, 13 and the yield stress are set as t and $\sigma_{y1}$ respectively, the full plastic bending moment $M_p$ can be given by the following expression.

$$M_p = p \times t^2 \times \sigma_{y1}/4$$

The section modulus Z of the weld seam Wa (bead) in the joint W1 can be given by $$z = \{(d+t/2^{1/2})^3 p - (d-t/2^{1/2})^3 (p-t/2^{1/2})\} \div \{6 \times (d+t/2^{1/2})\}$$

In order not to bring the weld bead into the plastic deformation even when the face plates 12, 13 reach their full plastic state, the stress of the weld seam Wa, which is calculated by $M_p$ and Z, should be lower than the yield stress $\sigma_{y2}$. In other words, dimensions d and p of the zigzag shape in the joint W1 are defined by the following expression.

$$M_p/Z < \sigma_{y2}$$

As a result, the joint W1 can achieve the modulus-of-rupture resistance which is not inferior to the strength of the face plates 12, 13. Therefore, the end sill 1 can absorb the collision energy sufficiently by using the strength of the end member 11 and the face plates 12, 13. In this case, if the total length of the weld seam Wa is excessively extended, the disadvantage in cost is produced because of the increase in the weld man-hour. Therefore, another condition of $$p/d > 1$$

may also be imposed on the depth d and the pitch p of the zigzag shape.

C) It is needless to say that the frames 16, 17 which extend longitudinally and laterally, as shown in FIG. 1A, are connected to the end member 11 and the rear frame 15. The frames 16, 17 are also connected to the upper and lower face plates 12, 13 by welding. This is because the reaction against the load applied at the time of collision of the vehicle A can be increased by integrating the face plates 12, 13 with the frames 16, 17 and thus an amount of the collision energy absorbed by the end sill 1 can be increased. In this case, since the end sill 1 is formed as the box type structural body, it is difficult to apply the welding between the face plates 12, 13 and the frame 16 or 17 from the inner side of the end sill 1. Therefore, so-called plug joints are applied thereto, i.e., a plurality of through holes are formed in the face plates 12, 13, as shown in FIG. 1A, and then inner peripheries of the through holes and the frames 16, 17 are welded from the outer side of the end sill 1.

D) The end member 11, which extends at the front end of the end sill 1, is formed to have such a curved shape that a center portion is protruded forward comparing to both end portions in the width direction of the vehicle A. According to the curved shape, it is possible to make soft the impact which is transferred to the vehicle A in collision. More particularly, at the beginning of the collision, only the center portion of the end member 11 collides with the opposite vehicle, etc., and then the contact portion between them gradually expands along the width direction along with the progress of the deformation of the end member 11, the face plates 12, 13, etc. and as a result the end sill 1 can absorb softly the collision energy while spending the time.

E) In addition to that the end sill 1 is provided at the same height position as the floor surface of the vehicle A, three horizontal projecting pieces 18 are formed at the front surface of the end member 11, as shown in FIG. 1C. The end member 11 has originally two projecting pieces 18 (flanges) because the channels are used as the end member 11, and thus three horizontal projecting pieces 18 are formed in total by adding one projecting piece to the flanges. If a plurality of projecting pieces 18 are formed in this way at the front surface of the end sill 1 provided at the predetermined height, these projecting pieces 18 act as so-called anti-climber when the vehicles A collide with each other. Therefore, it can be prevented that one vehicle A runs on to the floor of the opposite vehicle. This is because the projecting pieces 18 of both vehicles engage with each other during collision with the result that the vertical displacement of the end sill 1 in the opposite vehicle A is restricted. If the mutual end sills 1 of the vehicles A collide mutually and are not disengaged during deformation, a lot of collision energy can be absorbed by the deformation of the end sill 1. As a result, the damage of the portions except the end sill 1 of the vehicle can be suppressed to the lowest minimum.

Figure 3A:
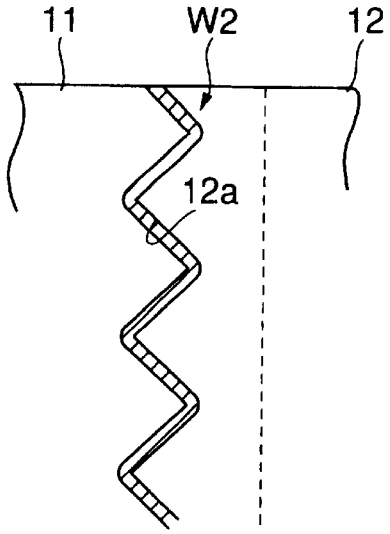
FIGS 3A, 3B, 3C are plan views showing joints W2, W3, W4 according to other embodiments of the present invention respectively.
Figure 3B:
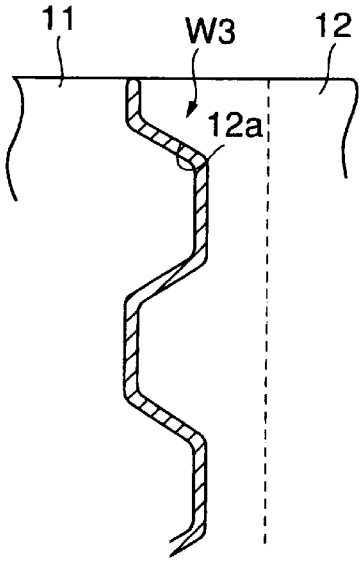
Figure 3C:
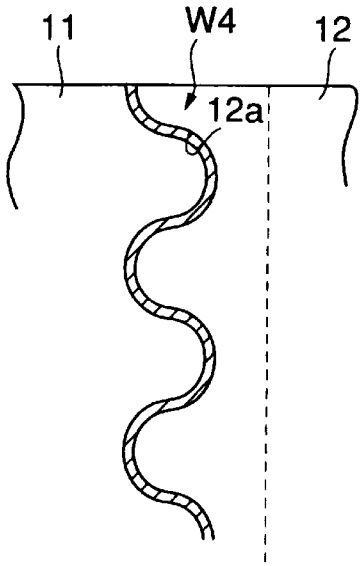

With the above, the embodiment of the present invention has been disclosed. However, it is a matter of course that the present invention should not be limited to the above embodiment. For example, the end member 11 and the face plate 12 (or the face plate 13) in the end sill 1 can be connected by any one of joints W2 to W4 shown in FIGS. 3A to 3C. In all joints W2 to W4, an edge portion 12*a* of the face plate 12 is formed as the zigzag or comb-teeth shape and then the fillet welding is applied only from the outer side along the edge portion 12*a*. The weld seam of the joint W2 in FIG. 3A has a triangular sawtooth shape, the weld seam of the joint W3 in FIG. 3B has a trapezoidal sawtooth shape, and the weld seam of the joint W4 in FIG. 3C has a circular-arc sawtooth shape. In all cases, these joints can have the higher strength than the linear joint W' in the related art (see FIG. 5) and can absorb a lot of collision energy. In addition, the present invention disclosed above can be accomplished as any other box type structural body other than the vehicle end sill.

According to the box type structural body of the present invention, when the structural body receives the load along the direction substantially perpendicular to the longitudinal axis of the intermediate member (end member), the joints are difficult to deform and break off. Therefore, this structural body can absorb a large energy upon its deformation.

According to the box type structural body of the present invention, the weld seam of the joint does not cause its plastic deformation until the plate member on the joint come up to its full plastic deformation state. In other words, since the joint portion can stand a considerably large bending moment, the structural body can absorb a high energy by using the strength of the members.

According to the vehicle end sill of the present invention, when the end member (intermediate member) is deformed by the load applied upon the collision of the vehicle, the end member can absorb a large collision energy, since the joint does not easily cause the deformation or the fracture. Therefore, the energy transferred from the end sill to the other portions of the vehicle can be lowered and thus damage of the vehicle can be reduced.

According to the vehicle end sill of the present invention, the vehicle end sill can absorb a high collision energy as mentioned above and in addition make the impact at the time of collision soft, since the end member (intermediate member) is formed as convex shape.

According to the vehicle end sill of the present invention, since there is no situation that the end sill runs on to the floor, etc. of the opposite vehicle upon the collision between the vehicles, the damage of the opposite vehicle can be suppressed to the lowest minimum.

What is claimed is:

1. A box shaped structural body comprising:

a pair of plate members each having an edge which is formed in a zigzag shape; the plate members facing each other with a clearance therebetween;

an intermediate member disposed between the plate members, the intermediate member having a pair of surfaces to which the zigzag edges of the plate members are superposed and attached respectively by lap weldings along the zigzag edges, the lap weldings being conducted outside the structural body, the intermediate member having a longitudinal axis which is substantially perpendicular to a direction along which a load is adapted to be applied to the structural body.

2. A box shaped structural body according to claim 1, wherein a depth and a pitch of the zigzag edge is set such that a stress caused by the load at a weld bead of the lap welding does not come up to its yield point even if a full plastic bending moment of the plate member is caused in a plane substantially perpendicular to the longitudinal axis of the intermediate member.

3. A box shaped structural body according to claim 1, wherein the zigzag shape includes a rectangular sawtooth shape.

4. A box shaped structural body according to claim 1, wherein the zigzag shape includes a triangular sawtooth shape.

5. A box shaped structural body according to claim 1, wherein the zigzag shape includes a trapezoidal sawtooth shape.

6. A box shaped structural body according to claim 1, wherein the zigzag shape includes a circular-arc sawtooth shape.

7. A vehicle end sill comprising:

a pair of plate members each having an edge which is formed in a zigzag shape; the plate members facing each other with a clearance therebetween;

an intermediate member extending in a width direction of an end portion of a vehicle, the intermediate member being disposed between the plate members, the intermediate member having a pair of surfaces to which the zigzag edges of the plate members are superposed and attached respectively by lap weldings along the zigzag edges, the lap weldings being conducted outside the vehicle end sill, the intermediate member having a longitudinal axis which is substantially perpendicular to a direction along which a load is adapted to be applied to the vehicle end sill.

8. A vehicle end sill according to claim 7, wherein a depth and a pitch of the zigzag edge is set such that a stress caused by the load at a weld bead of the lap welding does not come up to its yield point even if a full plastic bending moment of the plate member is caused in a plane substantially perpendicular to the longitudinal axis of the intermediate member.

9. A vehicle end sill according to claim 7, wherein the intermediate member is formed as a convex shape which protrudes against the direction of the load.

10. A vehicle end sill according to claim 7, further comprising two or more pieces projecting from a front surface of the intermediate member in a substantially horizontal direction and disposed at a predetermined height on the vehicle.

11. A vehicle end sill according to claim 7, wherein the zigzag shape includes a rectangular sawtooth shape.

12. A vehicle end sill according to claim 7, wherein the zigzag shape includes a triangular sawtooth shape.

13. A vehicle end sill according to claim 7, wherein the zigzag shape includes a trapezoidal sawtooth shape.

14. A vehicle end sill according to claim 7, wherein the zigzag shape includes a circular-arc sawtooth shape.

* * * * *